US009347123B2

(12) United States Patent
Somekawa et al.

(10) Patent No.: US 9,347,123 B2
(45) Date of Patent: May 24, 2016

(54) MG-BASE ALLOY

(75) Inventors: Hidetoshi Somekawa, Ibaraki (JP); Yoshiaki Osawa, Ibaraki (JP); Alok Singh, Ibaraki (JP); Toshiji Mukai, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 1344 days.

(21) Appl. No.: 13/144,993

(22) PCT Filed: Jan. 19, 2010

(86) PCT No.: PCT/JP2010/050575

§ 371 (c)(1),
(2), (4) Date: Sep. 14, 2011

(87) PCT Pub. No.: WO2010/082669

PCT Pub. Date: Jul. 22, 2010

(65) Prior Publication Data

US 2011/0315282 A1 Dec. 29, 2011

(30) Foreign Application Priority Data

Jan. 19, 2009 (JP) ..... 2009-008548

(51) Int. Cl.

| | |
|---|---|
| ***C22C 23/04*** | (2006.01) |
| ***C22F 1/06*** | (2006.01) |
| ***C22C 23/02*** | (2006.01) |

(52) U.S. Cl.

CPC . *C22F 1/06* (2013.01); *C22C 23/02* (2013.01); *C22C 23/04* (2013.01)

(58) Field of Classification Search

CPC ..... C22C 23/02

USPC ..... 148/667

See application file for complete search history.

(56) References Cited

U.S. PATENT DOCUMENTS

2003/0029526 A1 * 2/2003 Kim et al. ..... 148/403

FOREIGN PATENT DOCUMENTS

| | | |
|---|---|---|
| JP | 5-171330 | 7/1993 |
| JP | 5-311310 | 11/1993 |
| JP | 2001-353568 | 12/2001 |

(Continued)

OTHER PUBLICATIONS

Yuan et al., J. Mater. Res., vol. 19, No. 5, May 2004, pp. 1531-1538.*

(Continued)

*Primary Examiner* — Roy King
*Assistant Examiner* — Christopher Kessler
(74) *Attorney, Agent, or Firm* — Wenderoth, Lind & Ponack, L.L.P.

(57) ABSTRACT

The quasicrystal phase and/or quasicrystal-like phase particles, which is composed of the Mg—Zn—Al, are dispersed into Mg-base alloy material for strain working. The microstructure in this material does not include the dendrite structure, and the size of the magnesium matrix is 40 μm or less than 40 μm. The present invention shows that the quasicrystal phase and/or quasicrystal-like phase is able to form by addition of the Zn and Al elements except for the use of rare earth elements. In addition, the excellent trade-off-balancing between strength and ductility and reduction of the yield anisotropy, which are the serious issues for the wrought processed magnesium alloys, is able to obtain by the microstructure controls before the strain working process.

2 Claims, 22 Drawing Sheets

(56) References Cited

FOREIGN PATENT DOCUMENTS

| | | |
|---|---|---|
| JP | 2007-113037 | 5/2007 |
| WO | 2009/148093 | 12/2009 |

OTHER PUBLICATIONS

International Search Report issued Apr. 20, 2010 in International (PCT) Application No. PCT/JP2010/050575.

* cited by examiner

MG-BASE ALLOY

TECHNICAL FIELD

The present invention relates to Mg-base alloys that have a quasicrystalline phase dispersed in the magnesium matrix. More specifically, the Mg-base alloy materials improve the yield anisotropy without using of rare earth elements to apply for the electronic devices and structural parts. The invention also relates to strain-worked materials produced by the strain working of the Mg-base alloy materials.

BACKGROUND ART

Magnesium has great interested in the electronic devices and structural parts for the weight reduction, because magnesium is rich resource and the lightest in the structural materials. When magnesium is used as the structural parts, such as in the railcars and automobile, we have to develop high strength, ductility and toughness materials for the satisfaction of reliability and safety. Recently, a wrought process, known as a strain working process, is one of the effective methods to produce the high strength, ductility and toughness in magnesium alloys. For example, wrought materials have superior strength and ductility compared to cast materials, as described with reference to FIG. 15 (*Materials Science and Technology*, T. Mukai, H. Watanabe, K. Higashi, 16, (2000) pp. 1314-1319). Wrought materials also have superior strength and fracture toughness compared to cast materials, as described with reference to FIG. 16 (*Materia*, Hidetoshi Somekawa, 47, (2008) pp. 157-160).

However, since magnesium is the hexagonal crystalline structure, the wrought processed materials, which produced by strain working, e.g., rolling and extrusion, have texture, i.e., basal plane is parallel to the processing direction. Therefore, these materials show high tensile strength but low compression strength at room temperature. When the conventional wrought processed magnesium alloys apply to the structural parts, these materials have are very brittle and difficulties to deform in isotropic at the position, where compressive strain occurs. This point is a serious problem.

Recently, a unique phase, called a quasicrystalline phase, that does not have the periodic structure was found to develop in a Mg—Zn-RE (RE: rare earth elements=Y, Gd, Dy, Ho, Er, Tb) alloy.

The quasicrystalline phase is a unique characteristic, i.e., formation of coherent interface. Since the quasicrystal phase and magnesium shows a good lattice matching, the interface between quasicrystal phase and magnesium is very strong. Thus, when the quasicrystal phase is dispersed into the magnesium matrix, these materials resolve the above mentioned issues; reduction of texture and reduction of the yield anisotropy with high strength properties. However, there is a serious problem to form the quasicrystalline phase in magnesium alloy: The essential use of rare earth elements. The rare earth elements are very rare and there is always the risk of price increase, although these materials with addition of rare earth elements show excellent properties.

Specifically, for example, Patent Documents 1 to 3 describe the addition of the rare earth elements (particularly, Y) is necessary to form the quasicrystal phase in magnesium matrix. Patent Document 4 describes the addition of the rare earth elements (Y or other elements) is necessary to form the quasicrystal phase in magnesium matrix. In addition, this document shows that the grain refinement of matrix and the dispersion of quasicrystal phase lead to the reduction of yield anisotropy. The publication also describes the secondary formability conditions, such as temperature and speed, of the magnesium alloy with dispersion of quasicrystal phase particle. However, the problem is still remained; the additional rare earth element is necessary, same as all of these publications.

Meanwhile, there are some reports; a different approach that does not make use of rare earth elements. For example, Non-Patent Documents 1 and 2 describe the formation of Mg—Zn—Al quasicrystalline phase. However, since the quasicrystal is the only single crystal, the Mg matrix is absent. Non-Patent Document 3 shows that the size of Mg matrix is 50 μm or more than 50 μm because of the casting process. These publications thus do not describe exhibiting the high-strength, high-ductility, and high-toughness properties comparable to or superior to those by the addition of rare earth elements. In addition, it is also considered technically difficult to obtain such properties.

Patent Document 1: JP-A-2002-309332
Patent Document 2: JP-A-2005-113234
Patent Document 3: JP-A-2005-113235
Patent Document 4: WO2008-16150
Non-Patent Document 1: G. Bergman, J. Waugh, L. Pauling: *Acta Cryst*. (1957) 10 254.
Non-Patent Document 2: T. Rajasekharan, D. Akhtar, R. Gopalan, K. Muraleedharan: *Nature*. (1986) 322 528.
Non-Patent Document 3: L. Bourgeois, C. L. Mendis, B. C. Muddle, J. F. Nie: *Philo. Mag. Lett*. (2001) 81 709.

SUMMARY OF INVENTION

Problems that the Invention is to Solve

According to the above backgrounds, the subject in this patent is the formation of the quasicrystal phase with using of the conventional elements such as Al and Zn. In addition, we develop the magnesium alloys, which have (i) the trade-off balancing between the strength and ductility and (ii) the reduction of yield anisotropy, by the microstructural control before the strain working.

Means for Solving the Problems

The present invention provides a novel Mg-base alloy as a solution to the foregoing problems. The Mg-base alloy has the composition that does not include rare earth elements, except for unavoidable impurities. In addition, the quasicrystalline phase is dispersed in the matrix. Further, the microstructure, which is the prior to strain working, of the magnesium alloy does not have the dendrite structure.

Specifically, in Invention 1, the quasicrystal phase particles are dispersed into the magnesium matrix, and this material has a good formability by, the strain working. In addition, the quasicrystal phase is composed to the Zn and Al atoms, and the microstructure in this material dose not show the dendrite structure.

Invention 2 is a Mg-base alloy material for strain working according to Invention 1, where the quasicrystal phase and/or quasicrystal-like phase particle consists of Mg—Zn—Al.

Invention 3 is a Mg-base alloy material for strain working according to Invention 1 or 2, where the composition range is 6 wt % to 35 wt % for Zn and 2 wt % to 15 wt % for Al.

Invention 4 is a Mg-base alloy material for strain working according to any one of Inventions 1 to 4, where the area fraction of the quasicrystal phase and/or the quasicrystal-like phase is from 1% to 40%.

Invention 5 is a strain-worked material obtained by the strain working of Mg-base alloy material, characterized in that the Mg-base alloy material is the Mg-base alloy material for strain working of any one of Inventions 1 to 5, and the size of the magnesium matrix in the material, which was produced by the strain-working, is 40 μm or less than 40 μm.

Invention 6 is a strain-worked Mg-base alloy material according to Invention 5, where the size of the quasicrystal phase and/or the quasicrystal-like phase is 20 μm or less than 20 μm.

In invention 7 is a strain-worked material according to Invention 5 or 6, where this material has a tensile yield stress of 300 MPa or more than 300 MPa, a compression yield stress of 300 MPa or more than 300 MPa, a compression/tensile yield stress ratio of 1.0 to 1.2, a plastic energy value (E) of 20 or more than 20, and an elongation-to-failure of 0.06 or more than 0.06.

Invention 8 is a process for producing the Mg-base alloy material for strain working of any one of Inventions 1 to 4, the quasicrystal phase and/or the quasicrystal-like phase particle, which is composed of the Mg—Zn—Al, is dispersed into the matrix. In addition the dendrite structure is able to eliminate by the heat treatment.

Invention 9 is a process for producing the strain-worked Mg-base material of any one of Inventions 5 to 7. The grain size of the matrix in the magnesium material, which was obtained by the same process in Invention 8, is 40 μm or less than 40 μm by the strain working process.

Advantages of the Invention

The present invention shows that the quasicrystal phase particle is able to from by addition of both Zn and Al elements except for using rare earth elements. The strength in tensile and compression enhances by eliminating the dendrite structure before strain working process. The elimination of the dendrite structure leads to the reduction of yield anisotropy, and achievement of a trade-off balance between strength and ductility. In addition, this material has a superplastic behavior at high temperature region; this indicates an excellent secondary formability.

Curve: (a) Without heat treatment before the extrusion process (Comparative Example 5); (b) with heat treatment before the extrusion process (Example 3).

MODE FOR CARRYING OUT THE INVENTION

The essential elements are Mg, Zn and Al for a Mg-base alloy material and a strain-worked material of the present invention. Other components, raw materials, and unavoidable impurity components due to association with manufacture also may be contained, as long as these components do not inhibit the object and effects of the present invention.

Generally, when the composition of the present alloys is a (100-a-b)wt. % Mg-a wt. % Al-b wt. % Zn alloy, the composition range to form the Mg—Zn—Al quasicrystalline phase and/or the quasicrystal-like phase is considered to be $3 \leq a \leq 15$ and $6 \leq b \leq 12$, and $2 \leq a \leq 15$ and $12 < b \leq 35$. In the present invention, the dendrite structure is eliminated before warm strain working processes, such as extrusion, rolling, and forging. Then, the quasicrystalline phase and/or the quasicrystal-like phase with a micro-ordered size is dispersed in the magnesium matrix.

Figure 17:
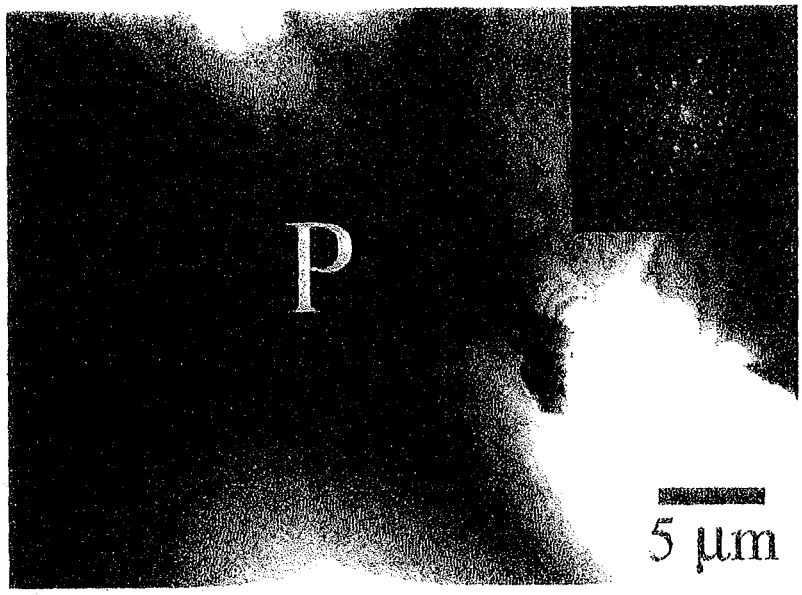
FIG. 17 is a microstructural image of the as-cast material of Comparative Example 1 by TEM.

Hereafter, the "quasicrystalline phase" is defined as the Mg32(Al,Zn)49 phase, that the selected-area electron diffraction image possesses a 3- or 5-fold rotational symmetry (see the image on the upper right of FIG. 17). The "quasicrystal-like phase" is defined as the Al2Mg5Zn2 phase.

To obtain the above mentioned structures, the dendrite structures should eliminate by a heat treatment after casting process. Since the heat-treatment temperature and time are greatly influenced by the composition ratio, these conditions are not able to be specified definitively. However, the temperature is considered to be a range of from 25×10° C. to 40×10° C. According to the below examples, the suitable heat-treatment temperature and holding time are desirably from 30×10° C. to 35×10° C. and from 1 to 72 hours (3 days), respectively.

The object and effects of the present invention is concerned with "reduction of the yield anisotropy". The reduction of yield anisotropy generally means that the compression yield stress/tensile yield stress ratio is 0.8 or more than 0.8.

In addition, a trade-off balance between strength and ductility means that strength and ductility are not inversely proportional; relationship between strength and ductility show a proportional.

To obtain these effects, the size of the magnesium matrix, i.e., average grain size, is 40 μm or less than 40 μm, preferably 20 μm or less than 20 μm, more preferably 10 μm or less than 10 μm. When the size of magnesium matrix (average grain size) in excess of 40 μm, it is difficult to achieve the yield strength of 300 MPa or more than 300 MPa, or the elongation-to-failure of 0.06 or more than 0.06.

In addition, the area fraction of the quasicrystal phase is desirably from 1% to 40%, preferably from 2% to 30%. When the area fraction is above 40%, the ductility becomes a low value. On the other hand, it is difficult to exhibit the high-strength and high-ductility, when the area fraction is less than 1%.

The area fraction is measured and calculated using a point counting method or an area method with a SEM or an optical microscopy. The size of the quasicrystal phase is preferably 20 μm or less than 20 μm, more preferably 5 μm or less than 5 μm, no smaller than 50 nm. When the size of quasicrystal phase is above 20 μm, the quasicrystal phase becomes a site of fracture during plastic deformation, and causes to a lower ductility. On the other hand, when the size of quasicrystal phase is less than 50 nm, these particle does not play the role of dislocation pinning. Thus, it is difficult to achieve high strength. The precipitate particle, i.e, intermetallics, also may be dispersed in the magnesium matrix instead of existence in quasicrystal phase particle. In order to obtain the above mentioned microstructures and properties, the material after the heat treatment should be applied the work strain of 1 or more than 1 at the temperature of 200~300° C. by the extrusion or other process.

In the present invention, the intermediate material, which is not applied the warm strain working process, is considered. The extruded material in the present invention satisfies all of the following representative property.

Tensile yield stress: 300 MPa or more than 300 MPa

Compression yield stress: 300 MPa or more than 300 MPa

Compression/tensile yield stress ratio: 1.0 to 1.2

Plastic energy value (E): 20 or more than 20

Elongation-to-failure: 0.06 or more than 0.06

The invention is described in more detail below based on several Examples.

Example 1

Pure magnesium (purity 99.95%), 8 mass % zinc and 4 mass % aluminum (hereafter denoted as, Mg-8Zn-4Al) were melted to produce a cast alloy (hereafter denoted as, "as-cast material"). The as-cast material was then heat treated in a furnace at 325° C. for 48 hours (hereinafter, "heat-treated material"). The heat-treated material was machined to prepare an extrusion billet with a diameter of 40 mm. The extrusion billet was charged into an extrusion container heated to 225° C. for keeping time of ½ hour, and then carried out the warm processing by extrusion. The extruded material had a diameter of 8 mm (hereafter denoted as, extruded material).

Figure 1:
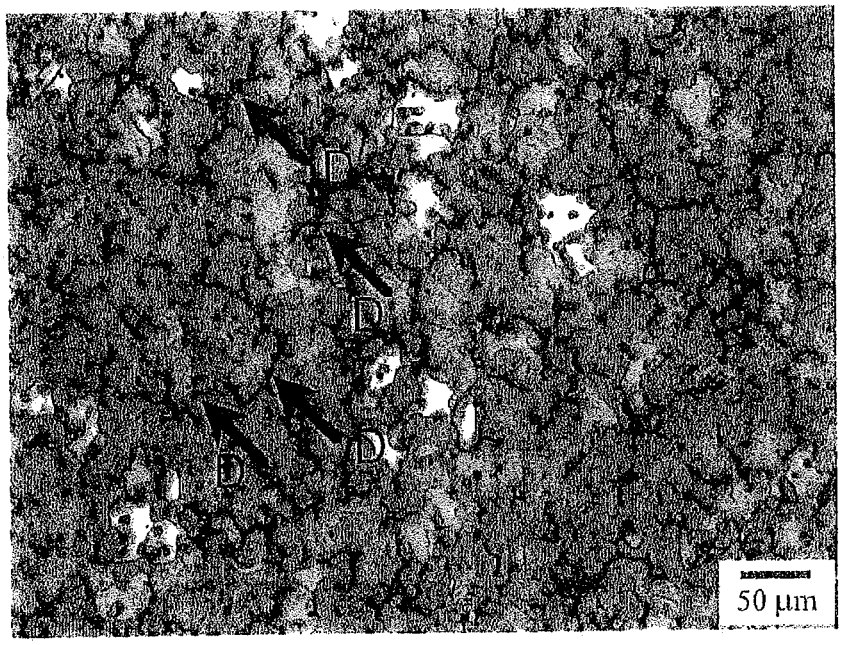
FIG. 1 is a microstructural image of the as-cast material of Example 1 by an optical microscopy.
Figure 2:
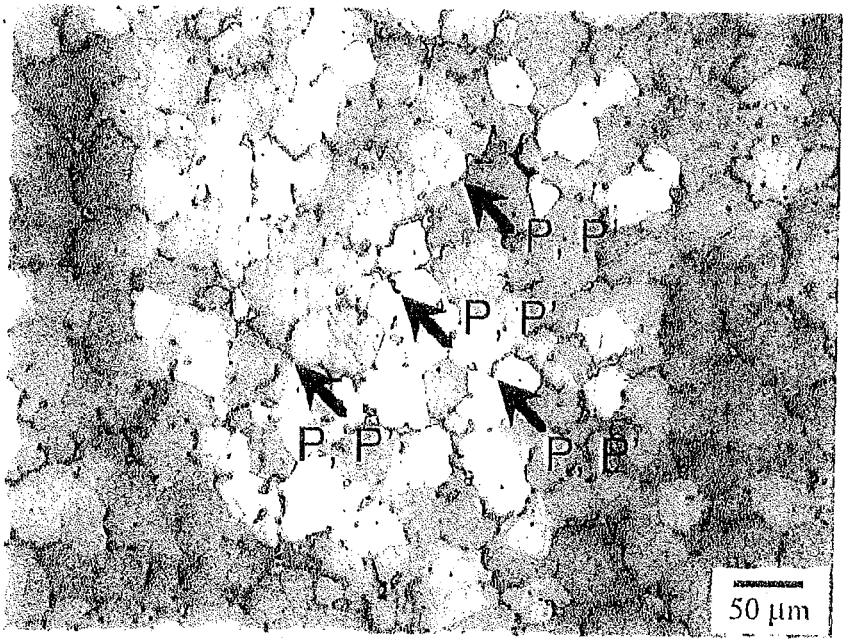
FIG. 2 is a microstructural image of the heat-treated material of Example 1 by an optical microscopy.
Figure 3:
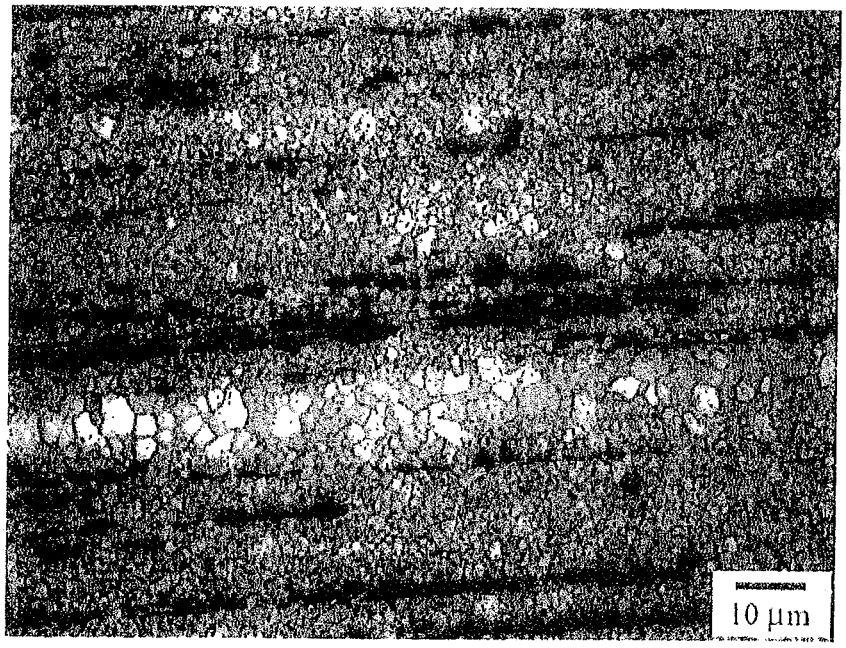
FIG. 3 is a microstructural image of the extruded material of Example 1 by an optical microscopy.
Figure 4:
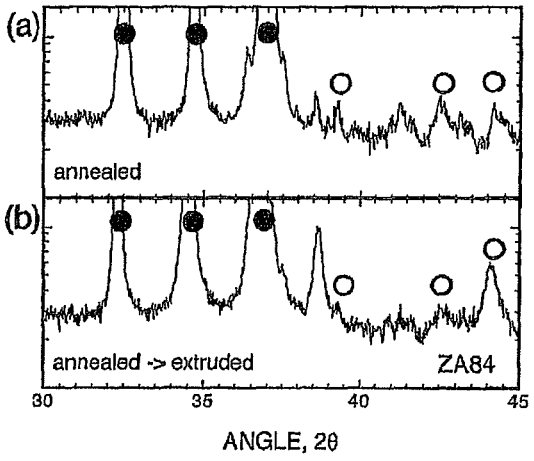
FIG. 4 is the results of the X-ray measurements in Example 1.

The microstructures of the as-cast material, heat-treated material, and extruded material were observed using an optical microscopy. X-ray measurements were also performed to identify the composition of particles in the heat-treated and extruded materials. FIGS. 1 to 3 show the microstructures of the as-cast material, heat-treated material, and extruded material, respectively. FIGS. 4(*a*) and (*b*) are the result of X-ray measurement of the heat-treated material and the extruded material, respectively. FIG. 1 shows that the as-cast material has a large number of dendrite structure (D). FIG. 2 shows that the dendrite structure (D) was eliminated and turned into distinct grain boundaries in the heat-treated material. In addition, the quasicrystalline phase particle (P) and intermetallics (P') with a several micron sizes are existed in the heat-treated material. The picric acid was used for the microstructural observation in this study. Corrosion time was 30 seconds, and all samples were processed under the same conditions.

FIG. 3 shows that the size of magnesium matrix is about 3~5 μm with the equi-axed structures (aspect ratio of 2 or less). Further, because the X-ray diffraction patterns in the heat-treated material (a) and extruded material (b) have the same, the phase does not change during the extrusion; the presence of the quasicrystalline phase and intermetallics is found to exist in the magnesium matrix even after the extrusion process. In the figure, the open circle indicates the quasicrystalline phase, i.e, the diffraction angle of 39.3°, 42.4°, 44.6°. The solid circle indicates the diffraction angle of the magnesium matrix.

Figure 5:
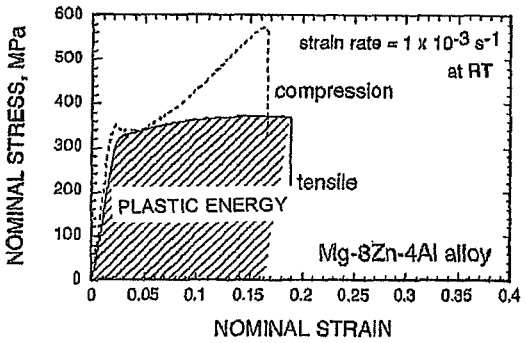
FIG. 5 is the nominal stress-nominal strain curve in a tensile and compression test at room temperature in Example 1.

Tensile test specimens (3 mm in diameter, 15 mm in length), and compression test specimens (4 mm in diameter, 8 mm in height) were machined from the extruded material. Each specimen was parallel to the extrusion direction, and the initial tensile and compression strain rate was $1\times10^{-3}$ $s^{-1}$. FIG. 5 represents the nominal stress-nominal strain curve in a tensile and compression test at room temperature. The tensile and compression yield stresses are 318 MPa and 350 MPa, respectively, showing excellent strength characteristics (particularly, compression strength). The yield stress is measured the stress value at a nominal strain of 0.2%, the elongation is measured the nominal strain value when the nominal stress decreased with at least 30%. The extruded material had a compression/tensile yield stress ratio of 1.1; which shows the reduction of yield anisotropy.

Example 2

The as-cast material, heat-treated material, extruded material were obtained in the same manner as in Example 1, except that the as-cast material had the composition Mg-6 wt % Zn-3 wt % Al.

Figure 6:
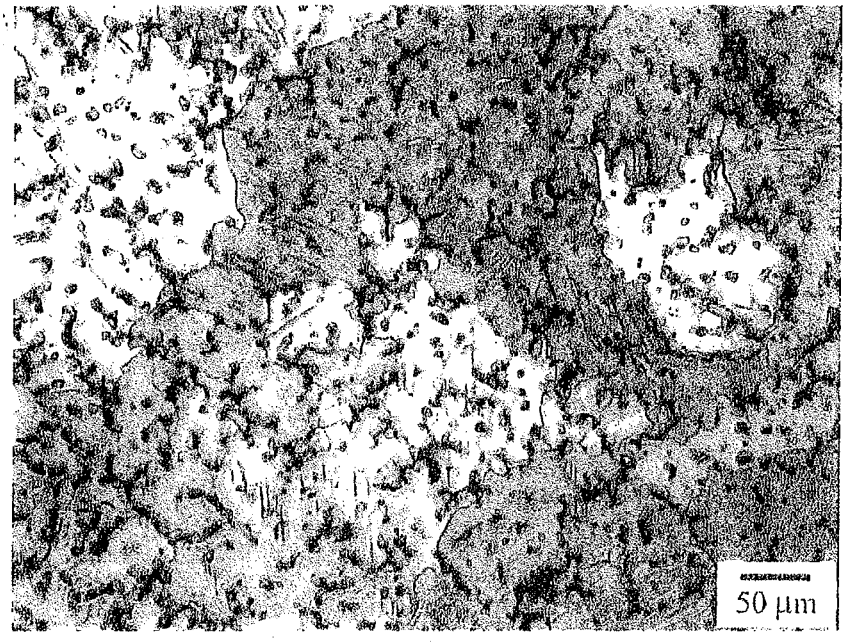
FIG. 6 is a microstructural image of the as-cast material of Example 2 by an optical microscopy.
Figure 7:
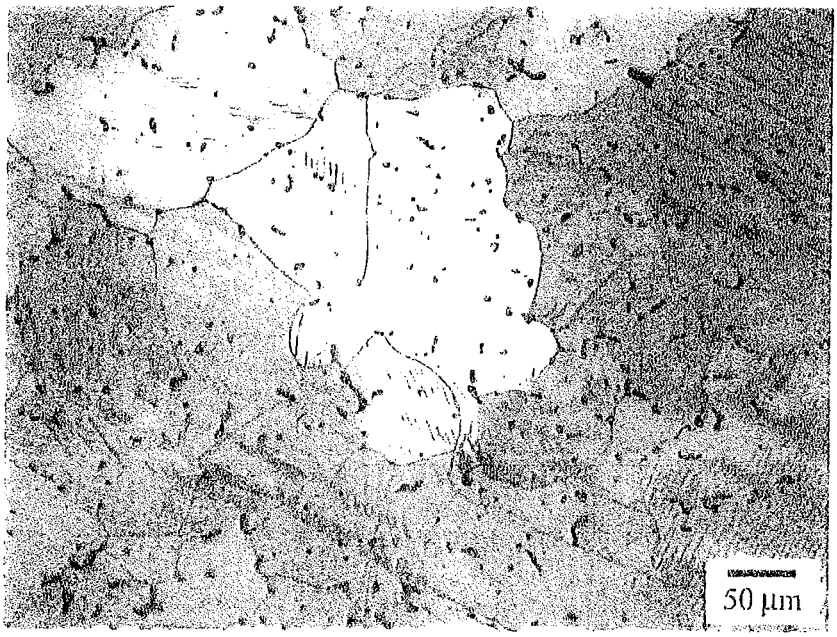
FIG. 7 is a microstructural image of the heat-treated material of Example 2 by an optical microscopy.
Figure 8:
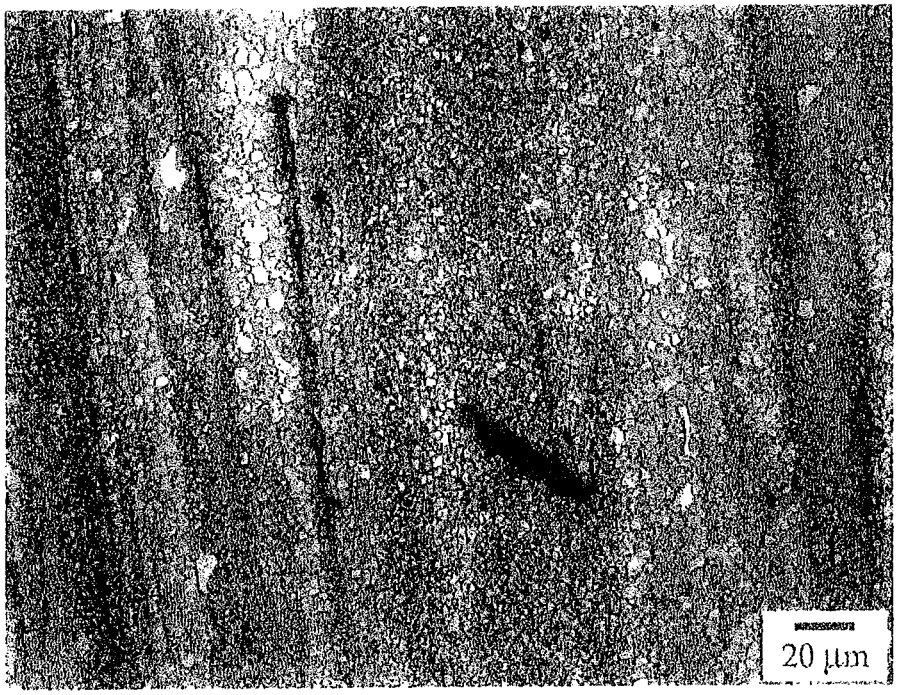
FIG. 8 is a microstructural image of the extruded material of Example 2 by an optical microscopy.
Figure 13:
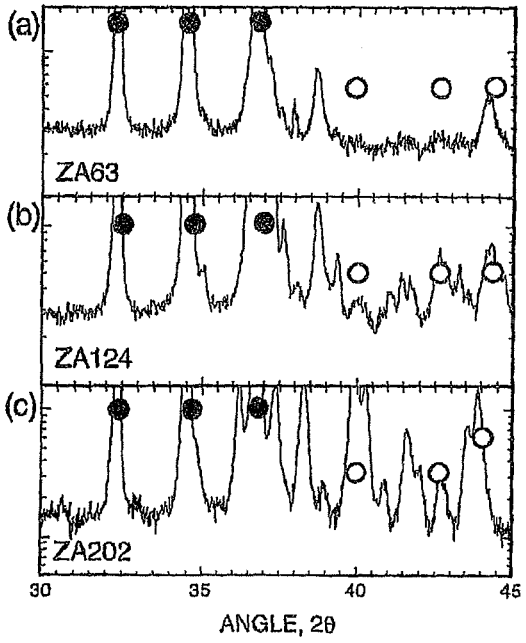
FIG. 13 is the results of the X-ray measurements in Examples 2, 3, and 4.

FIGS. 6 to 8 show the microstructures of the as-cast material, heat-treated material, and extruded material, respectively, using an optical microscopy. FIG. 13 (*a*) is the result of X-ray measurement in the extruded material. Same as FIG. 1, the as-cast material had the dendrite structure; however, the dendrites are eliminated and grain boundary is clearly observed by the heat treatment. It was also confirmed that quasicrystalline phase and intermetallic with about several micron sizes were dispersed into the magnesium matrix. In addition, same as Example 1, the result of X-ray measurement in FIG. 13 (*a*) shows that the extruded material exist in the quasicrystalline phase and intermetallics.

The tensile and compression test was carried out at room temperature, same as in Example 1. The results are presented in Table 1. The compression/tensile yield stress ratio of the extruded material is over 1.0, which show the reduction of yield anisotropy. This material is found to overcome an issue of wrought magnesium alloy.

Example 3

The as-cast material, heat-treated material, extruded material were obtained in the same manner as in Example 1, except that the as-cast material had the composition Mg-12 wt % Zn-4 wt % Al.

Figure 9:
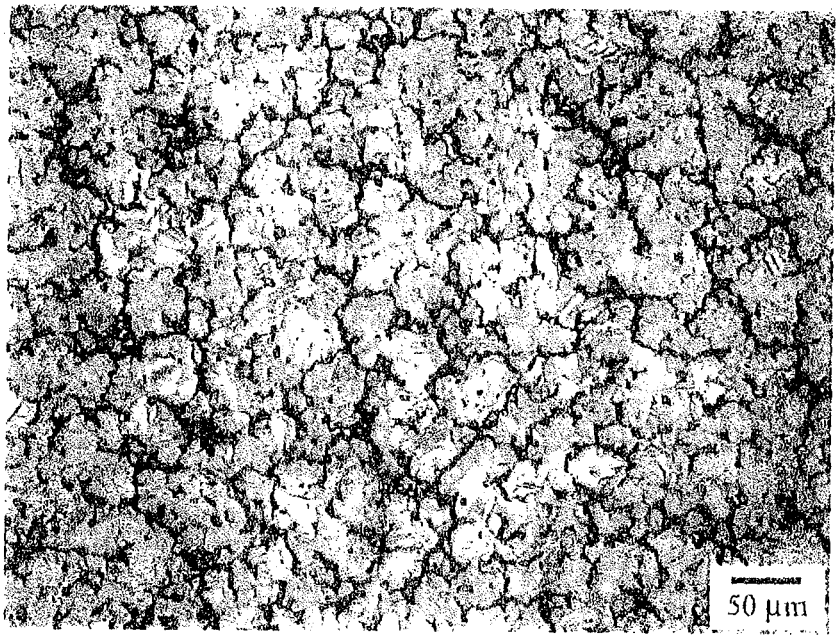
FIG. 9 is a microstructural image of the as-cast material of Example 3 by an optical microscopy.
Figure 10:
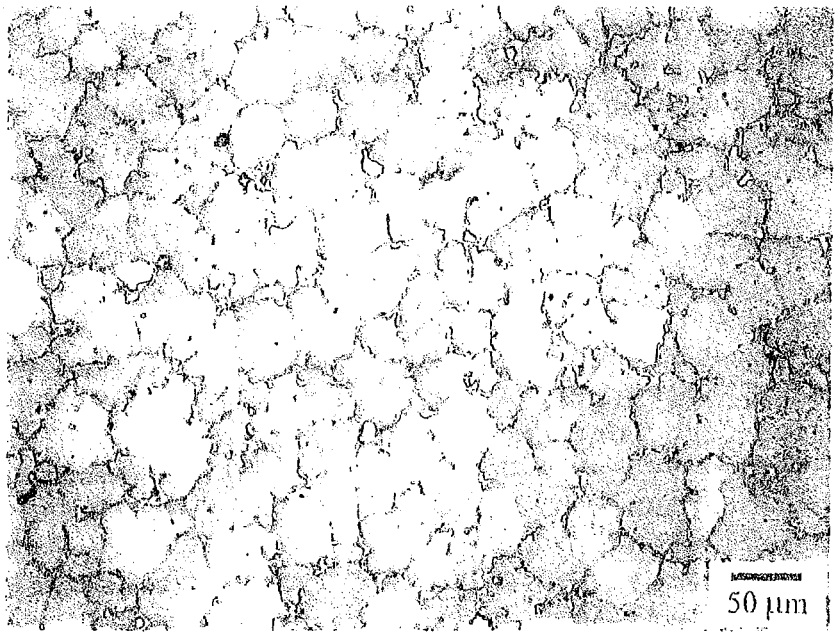
FIG. 10 is a microstructural image of the heat-treated material of Example 3 by an optical microscopy.

FIGS. 9 and 10 show the microstructures of the as-cast and heat-treated material, respectively, using an optical microscopy. FIG. 13 (*b*) is the result of X-ray measurement in the extruded material. Same as FIG. 1, the as-cast material had the dendrite structure; however, the dendrites are eliminated and grain boundary is clearly observed by the heat treatment.—It was also confirmed that quasicrystalline phase and intermetallic with about several micron sizes were dispersed. In addition, same as Example 1, the result of X-ray measurement in FIG. 13 (*b*) shows that the extruded material exist in quasicrystalline phase and intermetallic.

The tensile and compression test was carried out at room temperature, same as in Example 1. The results are listed in Table 1. The compression/tensile yield stress ratio of the extruded material is over 1.0, which show the reduction of yield anisotropy. This material is found to overcome an issue of wrought magnesium alloy. The tensile and compression test was conducted at room temperature as in Example 1.

Example 4

The as-cast material, heat-treated material, extruded material were obtained in the same manner as in Example 1, except that the as-cast material had the composition Mg-20 wt % Zn-2 wt % Al.

Figure 11:
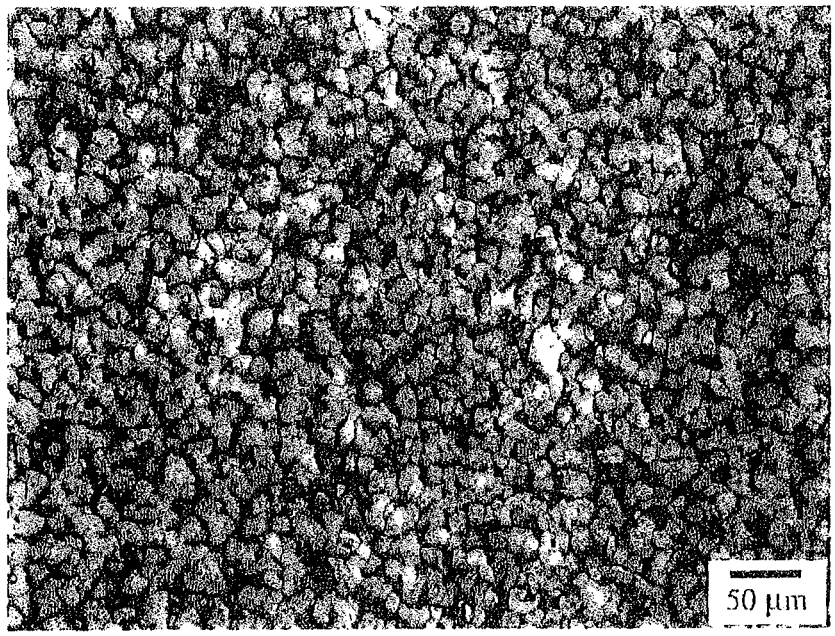
FIG. 11 is a microstructural image of the as-cast material of Example 4 by an optical microscopy.
Figure 12:
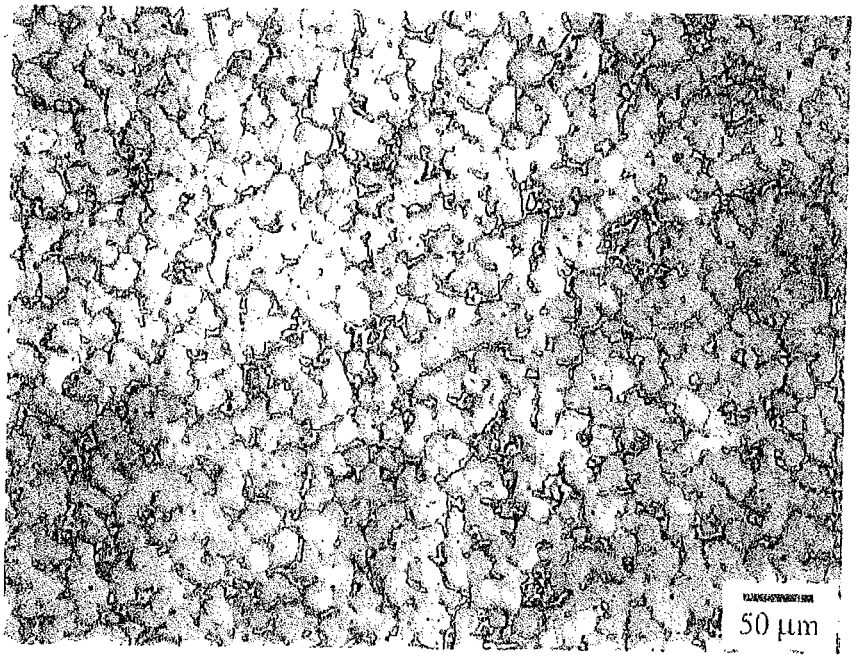
FIG. 12 is a microstructural image of the heat-treated material of Example 4 by an optical microscopy.

FIGS. 11 and 12 show the microstructures of the as-cast and heat-treated material, respectively, using an optical microscopy. FIG. 13 (*c*) is the result of X-ray measurement in the extruded material. Same as FIG. 1, the as-cast material had the dendrite structure; however, the dendrites are eliminated and grain boundary is clearly observed by the heat treatment.—It was also confirmed that quasicrystalline phase and intermetallic with about several micron sizes were dispersed. In addition, same as Example 1, the result of X-ray measurement in FIG. 13 (*c*) shows that the extruded material exist in quasicrystalline phase and intermetallic.

The tensile and compression test was carried out at room temperature, same as in Example 1. The results are presented in Table 1. The compression/tensile yield stress ratio of the extruded material is over 1.0, which show the reduction of yield anisotropy. This material is found to overcome an issue of wrought magnesium alloy. The tensile and compression test was conducted at room temperature as in Example 1.

Comparative Example 1

The extruded material was obtained in the same procedure in Example 1 using the same as-cast Mg-8Zn-4Al material. This extruded material was produced at the temperature of 300° C. without heat treatment.

The tensile and compression test of the extruded material was carried out at room temperature, same as in Example 1. The results are presented in Table 1.

The microstructure observation and X-ray measurement were also performed for the extruded material of Comparative Example as in Example 1. The observed region was parallel to the extrusion direction. The microstructural observation using a transmission electron microscope (TEM), and X-ray measurement of the as-casted material were also performed.

Figure 18:
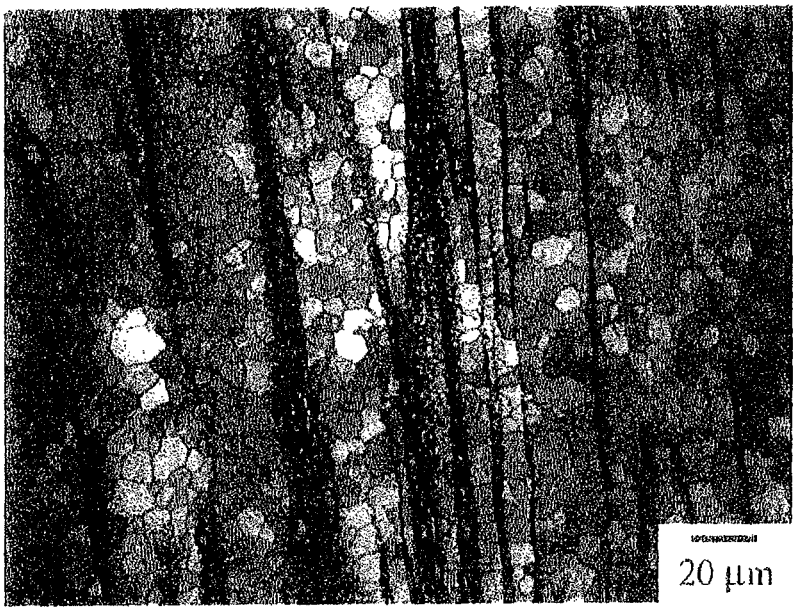
FIG. 18 is a microstructural image of the as-cast material of Comparative Example 1 by an optical microscopy.
Figure 19:
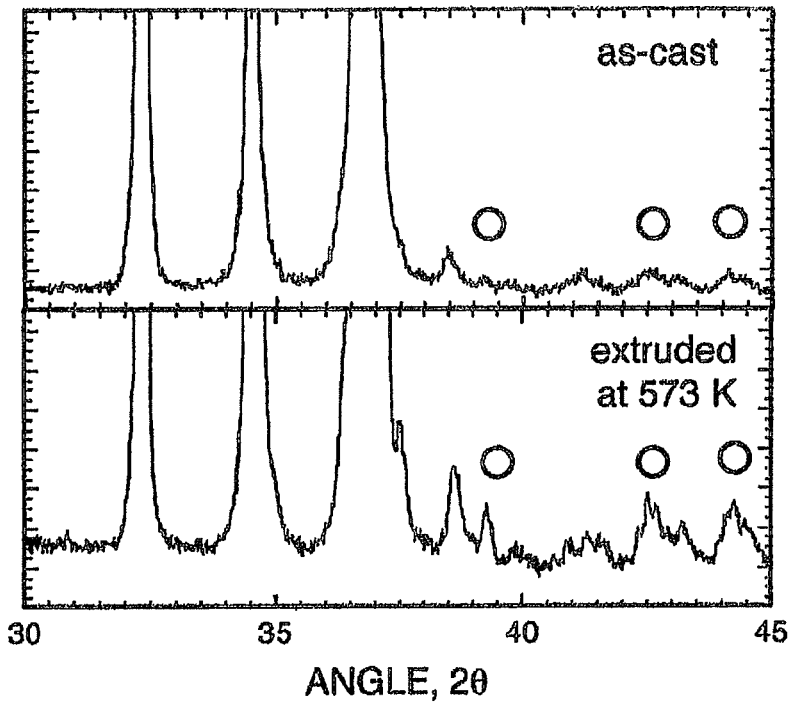
FIG. 19 is the results of the X-ray measurements in Comparative Example 1.

FIG. 17 shows typical TEM microstructural observation of the as-cast material. FIG. 18 is the microstructural image by optical microscopy of the extruded material. FIG. 19 represents the results of X-ray measurement of the both samples. FIG. 17 shows that the particle (P) is dispersed into the matrix. This particle was identified as the quasicrystal phase particle according to the selected-area diffraction pattern. In addition, FIG. 18 shows that the average size of magnesium matrix is about 12 μm with equi-axed structures. The average grain size was obtained by using a linear intercept method. Because the X-ray patterns of the both samples shown in FIGS. 17 and 18 are the same as FIG. 5, the presence of the quasicrystalline phase in the magnesium matrix was confirmed even after the extrusion process. The open circle in FIG. 19 indicates the diffraction angle of the quasicrystal phase; 39.3°, 42.4°, 44.6°.

Figure 20:
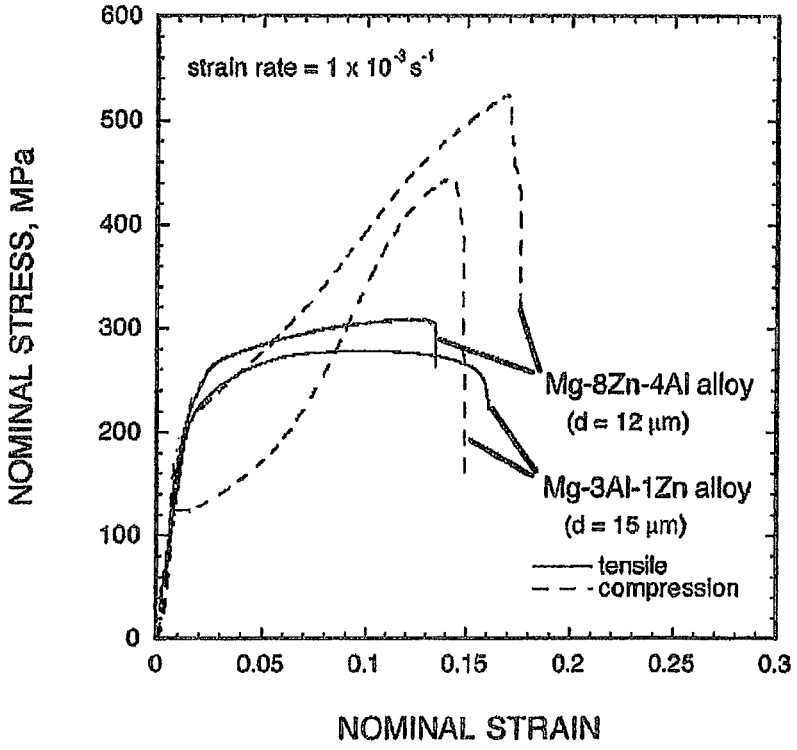
FIG. 20 is the nominal stress-nominal strain curve in a tensile and compression test at room temperature in Comparative Example 1 and in Comparative Example 2.

Tensile test specimens (3 mm in diameter, 15 mm in length), and compression test specimens (4 mm in diameter, 8 mm in height) were machined from the extruded material. Each specimen was parallel to the extrusion direction, and the initial tensile and compression strain rate was $1\times10^{-3}$ $s^{-1}$. FIG. 20 represents the nominal stress-nominal strain curve obtained by a tensile and compression test at room temperature. The mechanical properties are summarized in Table 1. The yield stress is measured the stress value at a nominal strain of 0.2%, the elongation is measured the nominal strain value when the nominal stress decreased with at least 30%.

Comparative Example 2

As Comparative Example 2, FIG. 20 also represents the nominal stress-nominal strain curve of the conventional wrought magnesium alloy, i.e., Mg-3 wt % Al-1 wt % Zn extruded material (initial grain size; about 15 μm). Both materials had a similar grain size; however, the tensile and compression yield stresses of the extruded material of Comparative Example 1 were 228 MPa and 210 MPa, respectively.

Comparative Example 3

Figure 21:
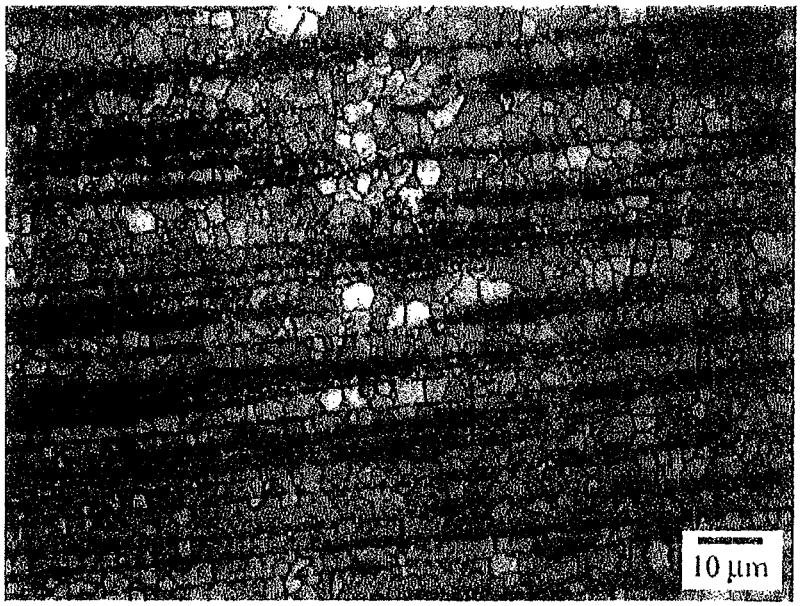
FIG. 21 is a microstructural image of the as-cast material of Comparative Example 3 by an optical microscopy.
Figure 22:
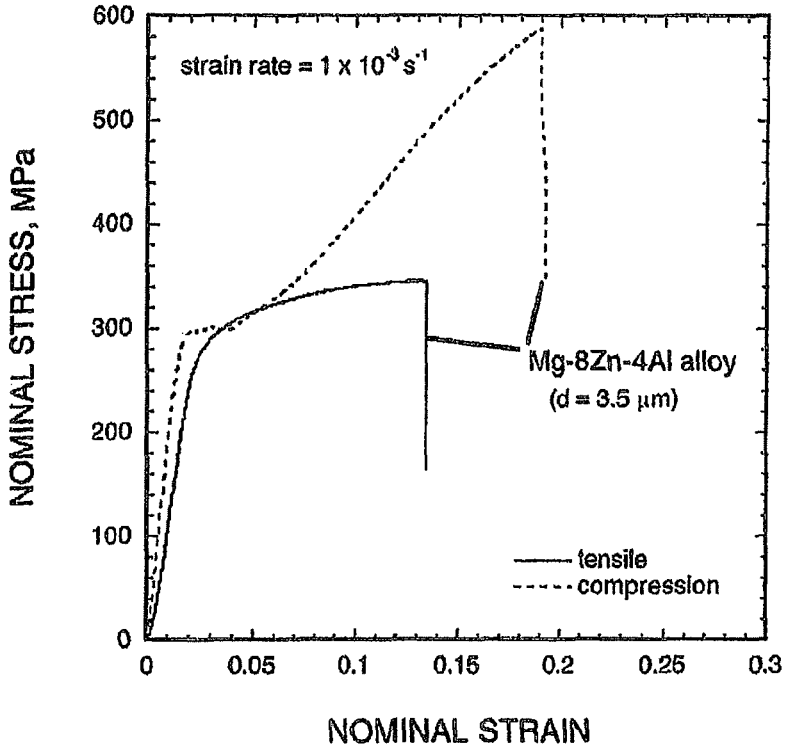
FIG. 22 is the nominal stress-nominal strain curve in a tensile and compression test at room temperature in Comparative Example 3.

The as-casted Mg-8Zn-4Al material, which was not carried out heat treatment, was extruded at the temperature of 225 C with a diameter of 8 mm, same procedure as in Comparative Example 1. The microstructural observation, and the tensile and compression test (RT) were performed under the same conditions used in Example 1. FIG. 21 represents the microstructure of the extruded material. FIG. 22 represents the nominal stress-nominal strain curve obtained by the tensile and compression test at room temperature. FIG. 21 shows that the average size of magnesium matrix is 3.5 μm. From FIG. 22, the tensile and compression yield stresses were 275 MPa and 285 MPa, respectively.

Comparative Example 4

The as-casted Mg-6Zn-3Al material, which was not carried out heat treatment, was extruded, same procedure as the Comparative Example 3.

The tensile and compression test of the extruded material was performed at the room temperature, as in Comparative Example 1. The results are presented in Table 1.

Comparative Example 5

The as-casted Mg-12Zn-4Al material, which was not carried out heat treatment, was extruded, same procedure as the Comparative Example 3.

The tensile and compression test of the extruded material was performed at the room temperature, as in Comparative Example 1. The results are presented in Table 1.

Comparative Example 6

The as-casted Mg-20Zn-2Al material, which was not carried out heat treatment, was extruded, same procedure as the Comparative Example 3.

The tensile and compression test of the extruded material was performed at the room temperature, as in Comparative Example 1. The results are presented in Table 1.

TABLE 1

| | | Comparative Example | | | | | | Example | | | |
|---|---|---|---|---|---|---|---|---|---|---|---|
| | Unit | 1 | 2 | 3 | 4 | 5 | 6 | 1 | 2 | 3 | 4 |
| Zn:Al content | wt % | 8:4 | 1:3 | 8:4 | 6:3 | 12:4 | 20:2 | 8:4 | 6:3 | 12:4 | 20:2 |
| Zn/Al(Zn + Al) | wt % | 2(12) | 0.33(4) | 2(12) | 2(9) | 3(16) | 10(22) | 2(12) | 2(9) | 3(16) | 10(22) |
| Crystal grain diameter | μm | 12 | 15 | 3.5 | 3 | 3 | 3 | 3-5 | 3-5 | 3-5 | 3-5 |
| Tensile yield Stress | MPa | 228 | 215 | 275 | 233 | 290 | 330 | 318 | 308 | 337 | 311 |
| Maximum tensile strength | MPa | 309 | 227 | 345 | 315 | 356 | 383 | 372 | 355 | 370 | 346 |
| Elongation to failure | | 0.134 | 0.161 | 0.132 | 0.207 | 0.11 | 0.043 | 0.192 | 0.217 | 0.129 | 0.066 |
| Compression yield stress | MPa | 210 | 127 | 285 | 231 | 319 | 378 | 350 | 317 | 358 | 336 |
| Compression/tensile yield stress ratio | | 0.92 | 0.59 | 1.04 | 0.99 | 1.1 | 1.15 | 1.1 | 1.03 | 1.06 | 1.08 |
| Plastic energy value (E) | | 32.8 | 32.7 | 37.2 | 52.6 | 31.6 | 13.2 | 61.1 | 67.3 | 41 | 22 |

Table 1 shows that the heat treatment before the extrusion causes to improve the plastic energy, E. In addition, these materials indicate the trade-off-balancing between strength and ductility.

Hereafter, "plastic energy value (E)" is defined as the area in the stress-strain curve, marked in FIG. 5. The materials with a large area, E, is found to indicate the high strength and ductility.

Regarding as the object and effect in the present patent, i.e., "reduction of the yield anisotropy" and "achieving a trade-off balance between strength and ductility", the results of Examples 1 to 4 shows the excellent properties.

Specifically, the present materials have a tensile yield stress of 300 MPa or more than 300 MPa, a compression yield stress of 300 MPa or more than 300 MPa, a compression/tensile yield stress ratio of 1.0 to 1.2, a plastic energy value (E) of 20 or more than 20, and an elongation-to-failure of 0.06 or more than 0.06.

Example 5

Figure 14:
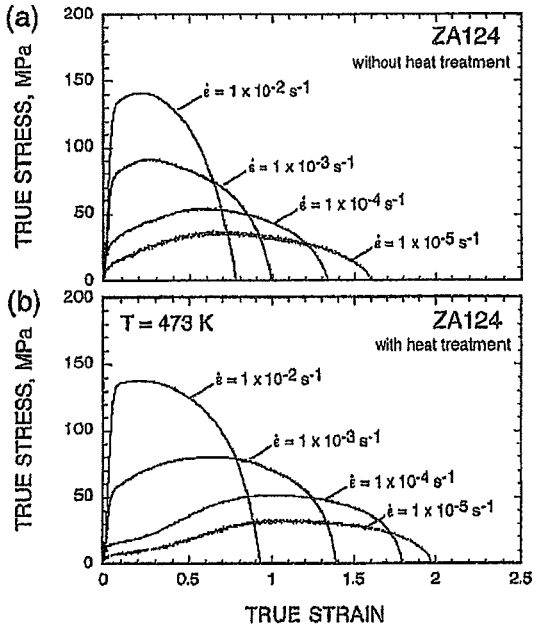
FIG. 14 is a variation of true stress as a function of true strain in the high temperature tensile test of Mg-12Al-4Zn.
Figure 15:
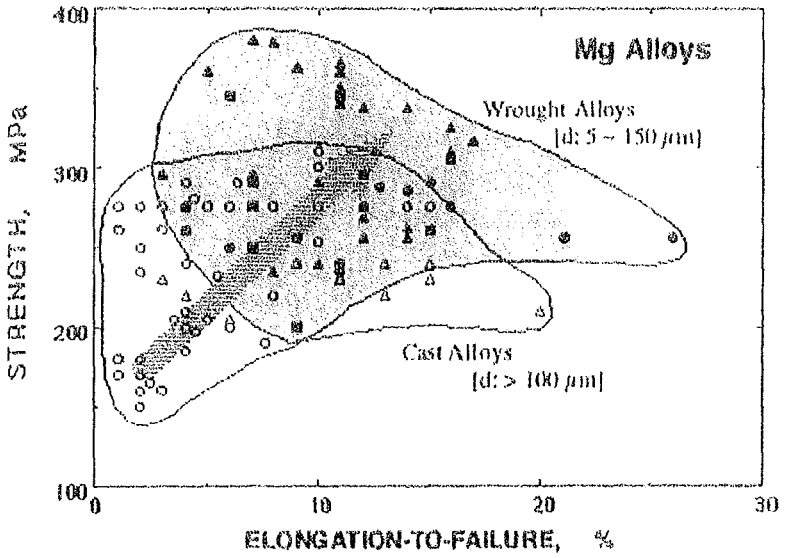
FIG. 15 is the relationship between the strength and the elongation-to-failure of wrought and cast magnesium alloys.
Figure 16:
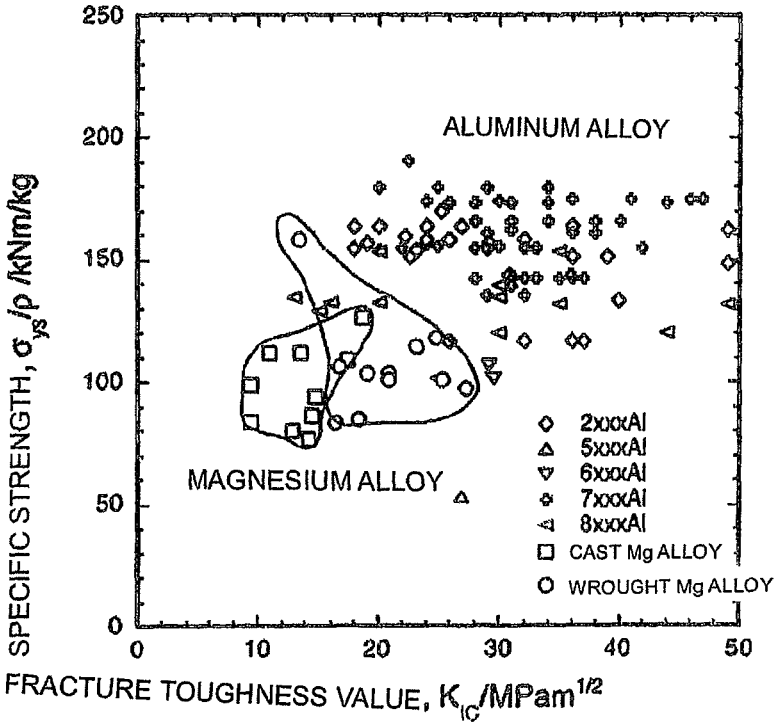
FIG. 16 is the relationship between the specific strength (=yield stress/density) and the fracture toughness value of wrought and cast magnesium alloys.

The high temperature tensile tests were carried out to investigate the superplastic behavior using the extruded materials produced in Examples 1 to 4 and Comparative Examples 3 to 6. Tensile test specimens (2.5 mm in diameter, 5 mm in length) were machined from the extruded materials. Each tensile specimen was parallel to the extrusion direction. The strain rate was constant and ranges from $1\times10^{-2}$ to $1\times10^{-5}$ $s^{-1}$. Temperature was 200° C. FIG. 14 represents the true stress-true strain curve of the tensile test at 200° C. in Example 3 and in Comparative Example 5. This figure shows that the elongation-to-failure increases with decrease in strain rate. In addition, the elongation-to-failure of the material with heat treatment is higher than that in the material without heat treatment. Table 2 summarizes the results of tensile test at temperature of 200° C. Table 2 and FIG. 14 show that the elongation-to-failure tends to improve by the heat treatment; this result indicate the excellent deformability and formability.

TABLE 2

| Strain | Comparative Example | | | | Example | | | |
|---|---|---|---|---|---|---|---|---|
| rate, $s^{-1}$ | 3 | 4 | 5 | 6 | 1 | 2 | 3 | 4 |
| Zn:Al content (wt %) | 8:4 | 6:3 | 12:4 | 20:2 | 8:4 | 6:3 | 12:4 | 20:2 |
| Zn/Al (Zn + Al wt %) | 2(12) | 2(9) | 3(16) | 10(22) | 2(12) | 2(9) | 3(16) | 10(22) |
| $1\times10^{-5}$ | 397 | 326 | 390 | 390 | 297 | 415 | 617 | 442 |
| $1\times10^{-4}$ | 298 | 217 | 278 | 315 | 363 | 317 | 500 | 354 |
| $1\times10^{-3}$ | 194 | 150 | 169 | 238 | 274 | 200 | 300 | 199 |
| $1\times10^{-2}$ | 130 | 99 | 117 | 154 | 149 | 132 | 152 | 125 |

DESCRIPTION OF REFERENCE NUMERALS AND SIGNS (P) Quasicrystal
(P') Intermetallic
(D) Dendrite structure
(E) Plastic energy

The invention claimed is:

1. A strain-worked Mg-base alloy material obtained by strain working a Mg-base alloy material represented by the formula (100-a-b)wt %, Mg-a wt %, Al-b wt %, Zn, wherein $3\leq a\leq 15$ and $6\leq b\leq 12$, or $2\leq a\leq 15$ and $12<b\leq 35$, wherein quasicrystal phase particles represented by the formula $Mg_{32}(Al, Zn)_{49}$ or quasicrystal-like phase particles represented by the formula $Al_2Mg_5Zn_2$ are dispersed into a magnesium matrix of the Mg-base alloy material, wherein a microstructure of the Mg-base alloy does not show a dendrite structure, wherein a size of the magnesium matrix in the strain-worked Mg-base alloy material is 40 μm or less than 40 μm, and wherein the strain-worked Mg-base alloy material has a tensile yield stress of 300 MPa or more than 300 MPa, a compression yield stress of 300 MPa or more than 300 MPa, a compression/tensile yield stress ratio of 1.0 to 1.2, a plastic energy value (E) of 20 or more than 20, and an elongation-to-failure of 0.06 or more than 0.06.

2. The strain-worked Mg-base alloy material according to claim 1, wherein a size of the quasicrystal phase or the quasicrystal-like phase is 20 μm or less than 20 μm.

* * * * *